United States Patent [19]

Johnson

[11] Patent Number: 4,640,101

[45] Date of Patent: Feb. 3, 1987

[54] PORTABLE BEVERAGE CHILLER

[76] Inventor: Ken A. Johnson, 6574 NW. Third St., Margate, Fla. 33063

[21] Appl. No.: 810,279

[22] Filed: Dec. 18, 1985

[51] Int. Cl.[4] ..... F25D 3/10

[52] U.S. Cl. ..... 62/294; 62/4; 62/457

[58] Field of Search ..... 62/293, 294, 457, 4, 62/223, 224

[56] References Cited

U.S. PATENT DOCUMENTS

| | | | |
|---|---|---|---|
| 2,805,556 | 9/1957 | Wang | 62/294 |
| 3,269,141 | 8/1966 | Weiss | 62/294 |
| 4,054,037 | 10/1977 | Yoder | 62/294 X |

*Primary Examiner*—Lloyd L. King

*Attorney, Agent, or Firm*—Robert J. Van Der Wall

[57] ABSTRACT

There is provided a portable refrigerating unit to be used for chilling beverages, the same having an outer shell insulated on the inside and an inner shell for holding a beverage container in close fitting relationship therewith. The inner shell is fabricated of a highly thermoconductive material, such as aluminum. The close fitting relationship with the beverage container allows an efficient conductive heat transfer when the outer surface of the inner shell is subjected to an evaporating refrigerant gas directed thereon by an evaporator tube that is mounted between the outer and inner shells. Refrigerant gas is supplied to the evaporator tube by a disposable pressurized refrigerant gas container. An ejector is provided for ejecting the beverage container after chilling.

11 Claims, 3 Drawing Figures

PORTABLE BEVERAGE CHILLER

FIELD OF THE INVENTION

The present invention relates to the field of portable refrigeration devices, and, more particularly, constitutes apparatus to rapidly chill a single beverage container of predetermined size, such as a beer can, using disposable refrigerant pressurized within a container which is also disposable after use.

BACKGROUND OF THE INVENTION

Due to a persistent desire for a chilled beverage in remote areas frequented by outdoor enthusiasts such as hikers, hunters and fishermen, a need exists for a means to provide a light, portable, compact and quick acting apparatus to chill beverages. Numerous devices have appeared in the past in an attempt to fill this need, but appear to be impractical or so complicated in design as to be expensive to manufacture.

A search of the prior art reveals previous efforts in this field, for example: U.S. Pat. No. 2,805,556 by Wang, et al., teaches a method of chilling unbottled or uncanned beverage in a mug-like container wherein the beverage is in direct contact with a cooling evaporator. The beverage is consumed directly from the device. The device also acts to maintain the temperature somewhat while the beverage is being consumed, making it generally suitable for use by an individual person. By contrast, the present invention is used with canned beverages which are removable and any one person may consume a can of beverage while a second can is being prepared and chilled by the present invention due to the design and much greater cooling capacity.

U.S. Pat. No. 2,773,358 by Palmer, et al., shows a device for use with a beverage can. This device uses a small refrigerant cartridge which, unlike the present invention, releases the refrigerant gas under the bottom of the beverage can and does not direct the gas toward the beverage can resulting in a serious loss in cooling capacity.

U.S. Pat. No. 3,862,548 by Ladany, et al., discloses a means of releasing refrigerant gas directly into a loose liquid which is very different from the present invention.

U.S. Pat. No. 3,302,428 by Stoner, et al., teaches a chilling system wherein a liquid medium is chilled and then conducted to a beverage container, a method quite unlike the present invention.

U.S. Pat. No. 3,919,856 by Beck, et al., discloses a device wherein the refrigerant gas container is immersed in the liquid to be chilled, the container removing heat from the liquid as the expanding gases escape the container, and is substantially different from the present invention.

U.S. Pat. No. 4,054,037 by Yoder, et al., discloses a device which at first glance resembles the present invention, but which, upon further examination, differs in several important ways from the present invention. The Yoder Patent teaches the use of an expensive coil type evaporator holding the beverage can in close physical contact for heat transfer. The present invention provides a novel evaporator tube having multiple discharge openings along its length, the openings facing directly against the wall of a holding chamber. The expanding refrigerant gas is released directly against the wall allowing optimum conductive heat transfer. Further, the present invention provides the novel ejection plunger for rapid removal of the chilled can from the chilling chamber. The last two features of the present invention are not found in any of the foregoing references and serve to clearly remove the present invention from the scope of the prior art.

SUMMARY OF THE INVENTION

Inasmuch as there is a widespread need for a means to provide a chilled beverage in remote areas where electricity is unavailable, and where refrigeration equipment does not exist, it is a primary object of the invention to provide a lightweight, portable and easy to use apparatus to fill this need.

It is a further object of the invention to provide a simple and efficient method of chilling beverages and to provide a design and construction that is relatively inexpensive to manufacture.

A still further object of the invention is to provide close fitting walls of the thermoconductive chilling chamber to obtain a maximum heat transfer.

An important other object of the invention is to provide the direct expansion of refrigerant gases against the surface of the aluminum thermoconductive wall of the chilling chamber to obtain maximum temperature reducing heat transfer at the surface of a beverage container. An additional object of the invention is to provide the manual ejector for removing a chilled container from the device.

Other objects of the invention include the use of disposable and readily obtainable containers of various refrigerant gases and that the apparatus may be used most anywhere and at any time, and to lower beverage temperatures by at least 30 degress, depending on ambient air temperatures, in five minutes.

Other objects and advantages will become apparent to those skilled in the art from the following descriptions, the drawings and the appended claims.

In accordance with the invention, there is provided a portable refrigerating unit to be used for chilling beverages, the same having an outer shell insulated on the inside and an inner shell for holding a beverage container in close fitting relationship therewith. The inner shell is fabricated of a highly thermoconductive material, such as aluminum. The close fitting relationship with the beverage container allows an efficient conductive heat transfer when the outer surface of the inner shell is subjected to an evaporating refrigerant gas directed thereon by an evaporator tube that is mounted between the outer and inner shells. Refrigerant gas is supplied to the evaporator tube by a disposable pressurized refrigerant gas container. An ejector is provided for ejecting the beverage container after chilling.

The invention will be better understood after reference to the following detained description and the drawings in which:

DETAILED DESCRIPTION

Figure 1:
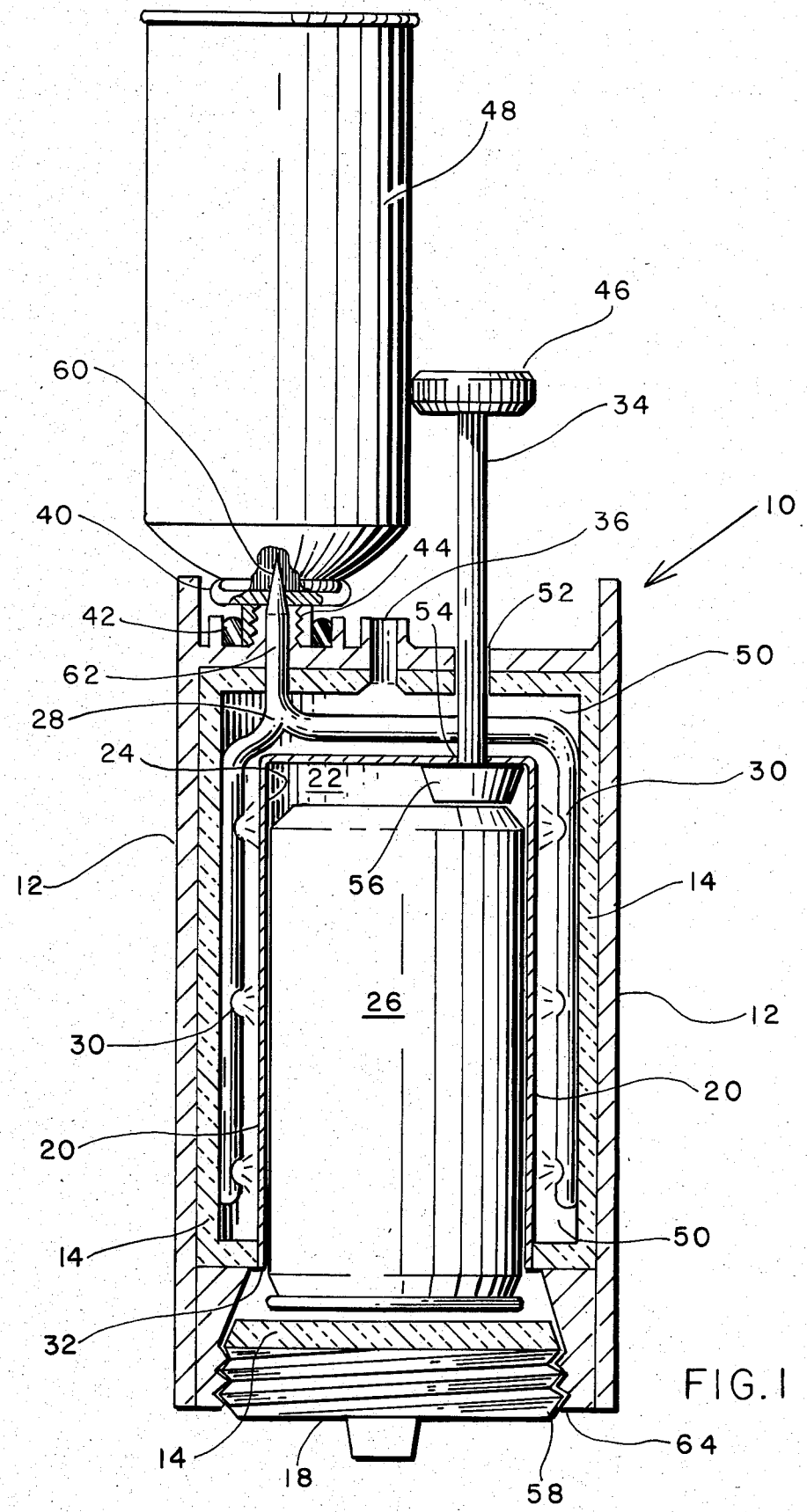
FIG. 1 is a sectional side view of the present invention.
Figure 2:
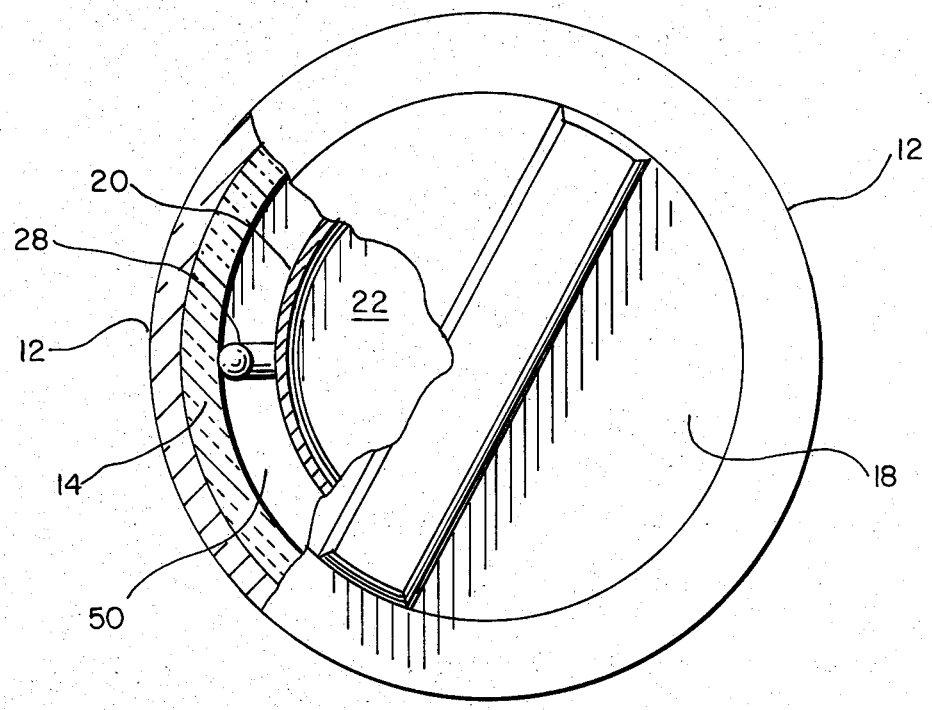
FIG. 2 is a partially broken bottom view of the present invention.
Figure 3:
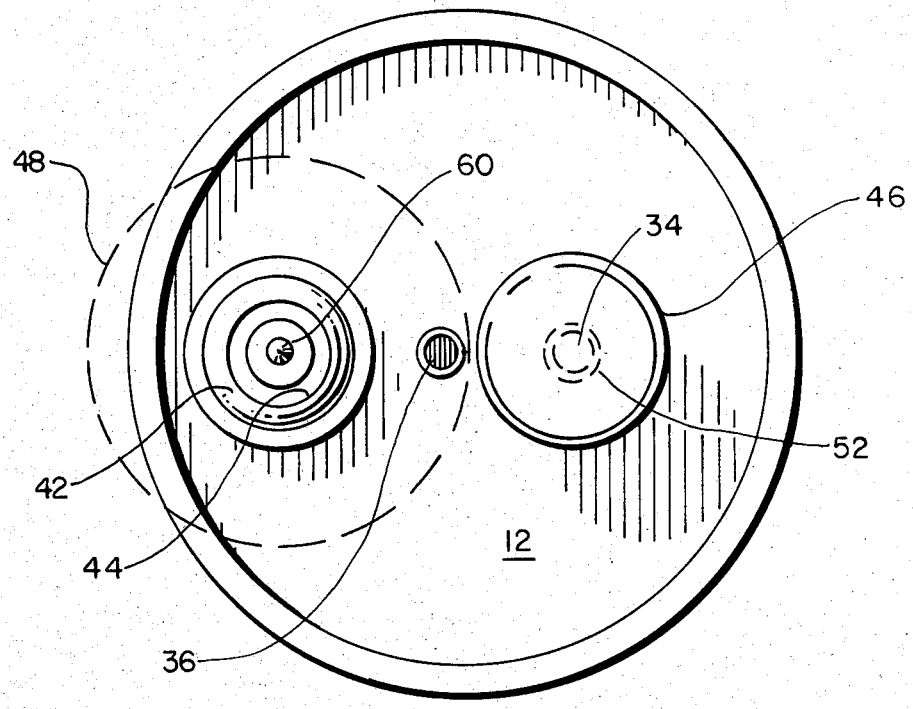
FIG. 3 is a top view of the invention showing the removable refrigerant gas container in phantom.

Referring to the drawings by characters of reference, FIGS. 1-3 illustrate a beverage cooler 10. FIG. 1 is a sectional side view. The cylindrical outer case 12 is provided with an insulated inner wall 14. The insulated inner wall 14 defines an evaporation chamber for expansion of refrigeration gas. The evaporation chamber for expansion of refrigeration gas. The evaporation chamber 50 is constructed with an open end for receiving and retaining a thermoconductive aluminum shell 20. The aluminum shell 20 defines a chilling chamber 22. The aluminum shell 20 is cylindrical in configuration and is also open at one end at 32 for receiving a beverage container of a diameter substantially conforming to the inside diameter of the shell 20 so as to provide a snugly fitting highly thermoconductive contact between the contacting surfaces of the aluminum shell 20 and a beverage container 26 for optimum chilling of the contents of the beverage container 26.

The interior 22 of the aluminum shell 20 also provides space for an ejector head 56 of a pushrod 34 providing a means to eject the beverage container 26 from the interior 22 of aluminum shell 20. The push rod 34 passes through a bore 52 of the outer case 12 and the insulated inner wall 14 and also through a bore 54 in the aluminum shell 20. A screw cap 18 is secured into the bottom of the outer case 12 by threads 58 of the cap 18 and threads 64 formed in the bottom opening of outer case 12. An insulating surface 14 of cap 18 provides insulation at this point. A needle valve 60 is mounted on the upper end of the evaporator tube 28.

When a refrigerant gas container 48 bearing a screw adaptor 40 is screwed onto a threaded connector 44, against seal 42, needle valve 60 mounted in hole 62 punctures the seal of refrigerant gas container 48, allowing gas to escape into evaporator tube 28. Evaporator tube 28 is of a novel and yet simple concept. It is provided with a series of discharge orifices 30, all of which face toward the opposing wall of aluminum shell 20 with the result that all expanding gases escaping from the evaporator tube 20 are directed against the wall of aluminum shell 20 for a more intense cooling of the aluminum wall. Beverage container 26, being in a close fitting relationship with the aluminum shell wall 24, is subject to efficient conductive heat transfer and therefore, rapid cooling.

Although the drawings show the evaporator tubes 28 as extending downwardly in a straight line parallel to the aluminum shell wall, it is not intended that the invention is limited to such configuration. Evaporation tube 28 may also be fabricated in a helical form so as to encircle or partially encircle aluminum shell wall 20 and distribute chilling effects around the circumference of the beverage container held therein. Beverage container 26 is allowed to remain within chilling chamber 22 until the refrigerant gas supply from container 48 is exhausted. Expanded gases released into evaporation chamber 50 escape into the atmosphere through exhaust port opening 36.

When the chilling process has been so completed, screw cap 18 is removed and the chilled beverage can is removed by downward pressure on ejector knob 46 which causes the ejector head 56 to force the beverage container from the interior of the chilling chamber 22. The ejector provides a positive means to remove the close fitted chilled beverage container even if ice or frost crystals form within chilling chamber 22, and is an important feature of the present invention. Although the foregoing description refers to use of the invention with beverages, it is not intended to limit the scope of the invention to beverages only, but it is intended that the invention may be used to cool and chill any and all materials that are adaptable thereto. The shape of the chilling chamber 22 may be modified accordingly.

Turning now to FIG. 2, a partially broken bottom view is illustrated. Outer shell 12 is shown with screw cap 18 in a closed position. Outer shell wall at 12 is shown with insulated wall 14, both in cross section, and evaporation chamber 50 together with the end of evaporator tube 28. Aluminum shell 20 is shown in cross section and the chilling chamber 22 is also illustrated.

FIG. 3 presents a top view of the invention and illustrates outer shell 12 with the position of a disposable refrigerant gas container 48, shown in phantom, mounted thereon as it would be connected to threaded connector 44 and bearing against seal 42. The end of the evaporator tube 28 and needle valve 60 receive refrigerant gas from disposable container 48. Also shown is exhaust port opening 35 and the top of ejector knob 46 with ejector rod 34. Hole 52 in outer shell 12 for entry and movement of ejector rod 34 is also shown in phantom.

Having described the presently preferred embodiments of the invention, it should be understood that various changes in construction and arrangement will be apparent to those skilled in the art and are fully contemplated herein without departing from the true spirit of the invention. Accordingly, there is covered all alternatives, modificiations and equivalents as may be included within the spirit and scope of the invention as defined in the appended claims.

What is claimed is:

1. A portable beverage chiller for cooling a removable beverage container placed therein comprising:

an outer shell;

an inner shell concentrically disposed within the outer shell and being of a thermoconductive material, said inner shell having interior dimensions for a close fitting relationship with the beverage container for efficient conductive heat transfer therewith, and with a first end of the inner shell defining an opening for receiving and removing the beverage container;

an annular gas expansion chamber disposed between the inner shell and outer shell;

an evaporator tube mounted within the gas expansion chamber and having at least one discharge orifice therein, said discharge orifice being disposed to discharge expanding refrigerant gas therefrom to impinge directly upon the inner shell;

an evaporator tube extension in fluid communication with the evaporator tube, said extension penetrating the outer shell and terminating in a connector for removable attachment to a source of compressed refrigerant gas;

an exhaust port through the outer shell for escape of expanded refrigerant gas from the expansion chamber; and an ejector penetrating the inner shell and outer shell for removal of the beverage container.

2. The portable beverage chiller of claim 1 which further comprises closure means cooperating with the first end of the inner shell to selectively block the opening therein when cooling the beverage container.

3. The portable beverage chiller of claim 1 which further comprises insulation attached to an interior wall of the outer shell.

4. The portable beverage chiller of claim 2 which further comprises insulation attached to an interior wall of the closure means.

5. The portable beverage chiller of claim 1 which further comprises a plurality of branch evaporator tubes, each having at least one discharge orifice and being in fluid communication with the evaporator tube.

6. The portable beverage chiller of claim 1 which further comprises sealing means attached to the connector to maximize passage of compressed refrigerant gas from its source to the evaporator tube extension.

7. The portable beverage chiller of claim 1 wherein the source of compressed refrigerant gas is a disposable container.

8. The portable beverage chiller of claim 1 wherein the ejector further comprises an external knob attached to a shaft to exert manual pressure for removal of the beverage container.

9. The portable beverage chiller of claim 1 wherein the ejector further comprises an internal flange attached to a shaft to distribute ejection pressure against the beverage container and to retain the ejector within the inner shell.

10. The portable beverage chiller of claim 1 wherein the evaporator tube extension further comprises a needle valve attached to said extension to puncture seals present on sources of compressed refrigerant gas.

11. The portable beverage chiller of claim 1 wherein the evaporator tube may be disposed in a helical configuration.

* * * * *